US010923810B2

(12) United States Patent
Rentz

(10) Patent No.: US 10,923,810 B2
(45) Date of Patent: Feb. 16, 2021

(54) SUPPLEMENTAL DEVICE FOR AN ANTENNA SYSTEM

(71) Applicant: Deere & Company, Moline, IL (US)

(72) Inventor: Mark L. Rentz, Torrance, CA (US)

(73) Assignee: DEERE & COMPANY, Moline, IL (US)

( * ) Notice: Subject to any disclaimer, the term of this patent is extended or adjusted under 35 U.S.C. 154(b) by 47 days.

(21) Appl. No.: 16/127,223

(22) Filed: Sep. 10, 2018

(65) Prior Publication Data

US 2020/0006847 A1 Jan. 2, 2020

Related U.S. Application Data

(60) Provisional application No. 62/691,953, filed on Jun. 29, 2018.

(51) Int. Cl.

| | |
|---|---|
| ***H01Q 21/00*** | (2006.01) |
| ***H01Q 1/52*** | (2006.01) |
| ***H01Q 1/38*** | (2006.01) |
| ***H01Q 1/48*** | (2006.01) |
| ***H01Q 19/18*** | (2006.01) |

(52) U.S. Cl.

CPC ..... *H01Q 1/523* (2013.01); *H01Q 1/38* (2013.01); *H01Q 1/48* (2013.01); *H01Q 19/18* (2013.01); *H01Q 21/0031* (2013.01)

(58) Field of Classification Search

CPC ..... H01Q 1/523; H01Q 1/38; H01Q 1/48; H01Q 19/18; H01Q 21/0031

USPC ..... 343/836

See application file for complete search history.

(56) References Cited

U.S. PATENT DOCUMENTS

| | | | | |
|---|---|---|---|---|
| 6,067,053 | A | 5/2000 | Runyon et al. | |
| 8,723,731 | B2 * | 5/2014 | Tatarnikov | H01Q 1/241 343/700 MS |
| 9,379,453 | B2 | 6/2016 | Rentz | |
| 10,158,178 | B2 * | 12/2018 | Bit-Babik | H01Q 3/247 |
| 10,505,279 | B2 * | 12/2019 | Celik | H01Q 9/0464 |
| 2003/0052825 | A1 | 3/2003 | Rao et al. | |
| 2011/0012808 | A1 | 1/2011 | Tatarnikov et al. | |
| 2013/0278475 | A1 * | 10/2013 | Sabielny | H01Q 1/286 343/769 |
| 2014/0176386 | A1 | 6/2014 | Rentz | |

(Continued)

FOREIGN PATENT DOCUMENTS

| | | | |
|---|---|---|---|
| CN | 105044736 | A | 11/2015 |
| CN | 207490094 | U | 6/2018 |
| WO | 2011092311 | A2 | 8/2011 |

OTHER PUBLICATIONS

Kunysz, W. A Three Dimensional Choke Ring Ground Plane Antenna. In Proceedings of the 16th International Technical Meeting of the Satellite Division of the Institute of Navigation, Sep. 2003, Portland (pp. 1883-1888).

(Continued)

*Primary Examiner* — Huedong X Mancuso

(57) ABSTRACT

In accordance with one embodiment, a supplemental device for an antenna system comprises a ring that provides a generally horizontal annular ground plane, where the ring has an interior circumference. A substantially annular wall rises or extends from the ring at or near the interior circumference. A set of radial members extends radially upward from the ring, the radial members spaced apart from each other.

33 Claims, 9 Drawing Sheets

(56) References Cited

U.S. PATENT DOCUMENTS

| | | | | |
|---|---|---|---|---|
| 2015/0077299 | A1* | 3/2015 | Tatarnikov | H01Q 19/00 343/749 |
| 2016/0261035 | A1 | 9/2016 | Chamseddine | |
| 2017/0149125 | A1* | 5/2017 | Huang | H01Q 1/521 |

OTHER PUBLICATIONS

European Search Report issued in counterpart European Patent Application No. 19181826.9 dated Dec. 10, 2019 (8 pages).

* cited by examiner

SUPPLEMENTAL DEVICE FOR AN ANTENNA SYSTEM

RELATED APPLICATION

This application claims the benefit of the filing date of and priority to U.S. Provisional Application Ser. No. 62/691,953, filed Jun. 29, 2018, which is incorporated herein by reference in its entirety.

FIELD

This disclosure relates to a supplemental device for an antenna system.

BACKGROUND

In certain prior art, Global Navigation Satellite Systems (GNSS) have become a utility with benefits to activities ranging from aircraft navigation to land survey. To achieve the highest possible accuracy in positioning and navigation, the antenna system should have high sensitivity to the received signals, while not distorting the received signals. For terrestrial satellite antennas, the sensitivity is achieved by a uniformly high isotropic gain in the upper hemisphere above a ground plane of the antenna, along with a low noise amplifier with a small noise figure. The immunity to distortion is addressed by using amplifiers and other circuits with substantially flat signal magnitude versus frequency responses across the GNSS bands of interest, among other things.

In the wireless communications field, reflected signals, alone or together with direct signals, can be referred to as multipath signals; particularly where there is interference between direct path signals and reflected signals observed simultaneously at a receiver. Because a reflected signal is coherent with the direct signal, the reflected signal can combine constructively or destructively with the direct signal, resulting in multipath fading when the combination is destructive. Although multipath fading is a problem with navigation receivers, even constructive combinations of the reflected signal and the direct signal can degrade position accuracy for navigation.

A GNSS receiver measures the time of arrival of the satellite signals at the antenna system, which makes it vulnerable to constructive combinations of the reflected signal with the direct path signal. The received multipath signal may result from the direct signal added to a reflected signal, which arrived later than the direct signal because it takes a longer path than the direct signal to get to the receive antenna. The received signal consists of a radio or microwave frequency carrier modulated with a digital sequence of symbols, such as bits. The symbol transitions of the digital sequence are fast events which provide crucial timing information. When a direct signal is combined with a reflected signal in the presence of multipath, the ideal sharp transition edge of the direct signal becomes a stretched out, distorted edge which conveys degraded timing information. Thus, there is a need for an improved supplemental device for an antenna system for a satellite receiver to reduce the reception of multipath signals, among other things.

SUMMARY

In accordance with one embodiment, a supplemental device for an antenna system comprises a ring that provides a generally horizontal annular ground plane, where the ring has an interior circumference. A substantially annular wall rises or extends vertically from the ring at or near the interior circumference. A set of radial members extends radially upward from the ring, the radial members spaced apart from each other.

BRIEF DESCRIPTION OF THE DRAWINGS

Like reference numbers in two or more drawings indicate like elements or features.

DETAILED DESCRIPTION

Figure 1:
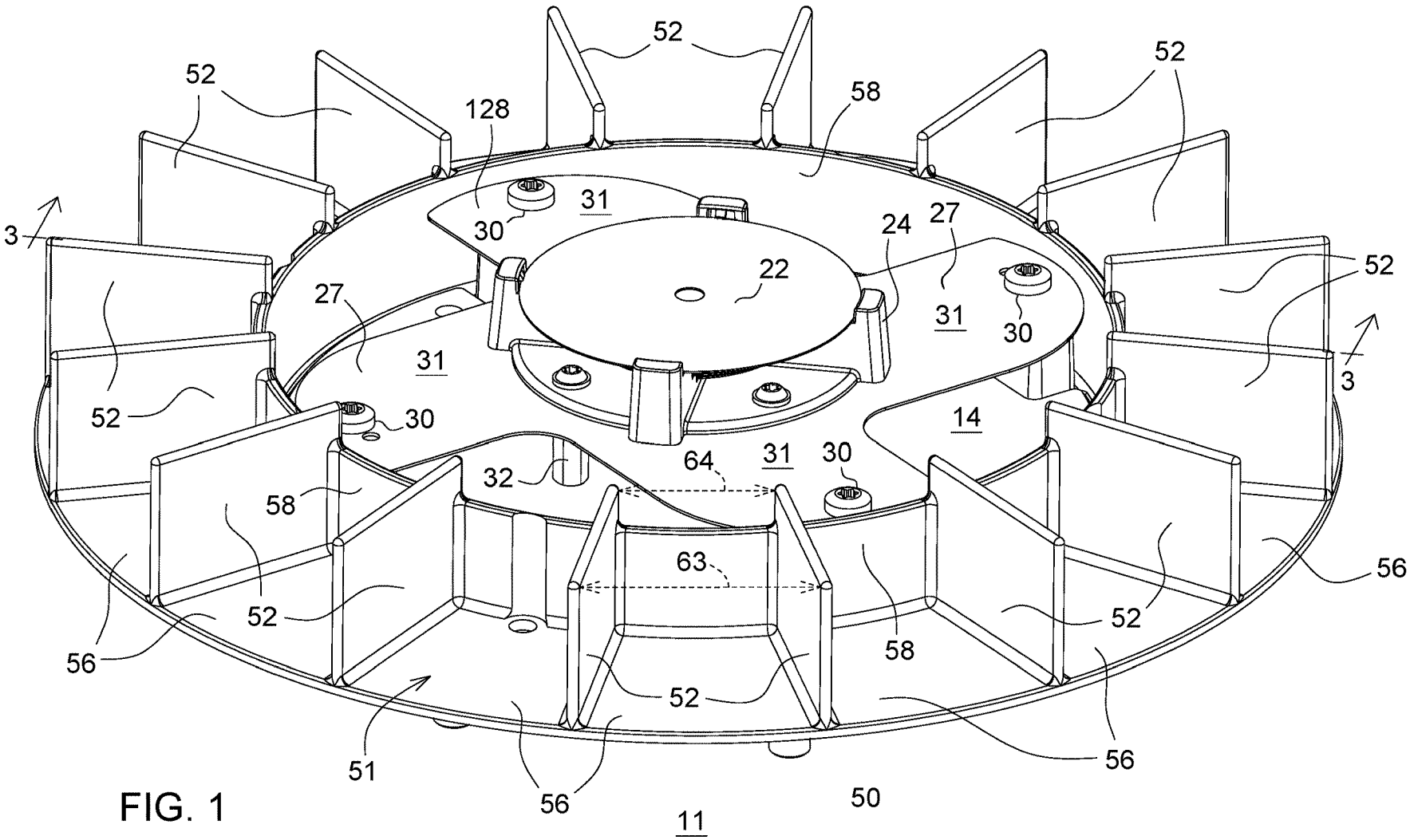
FIG. 1 is perspective top view of one embodiment of an antenna system that incorporates a supplemental device.
Figure 2:
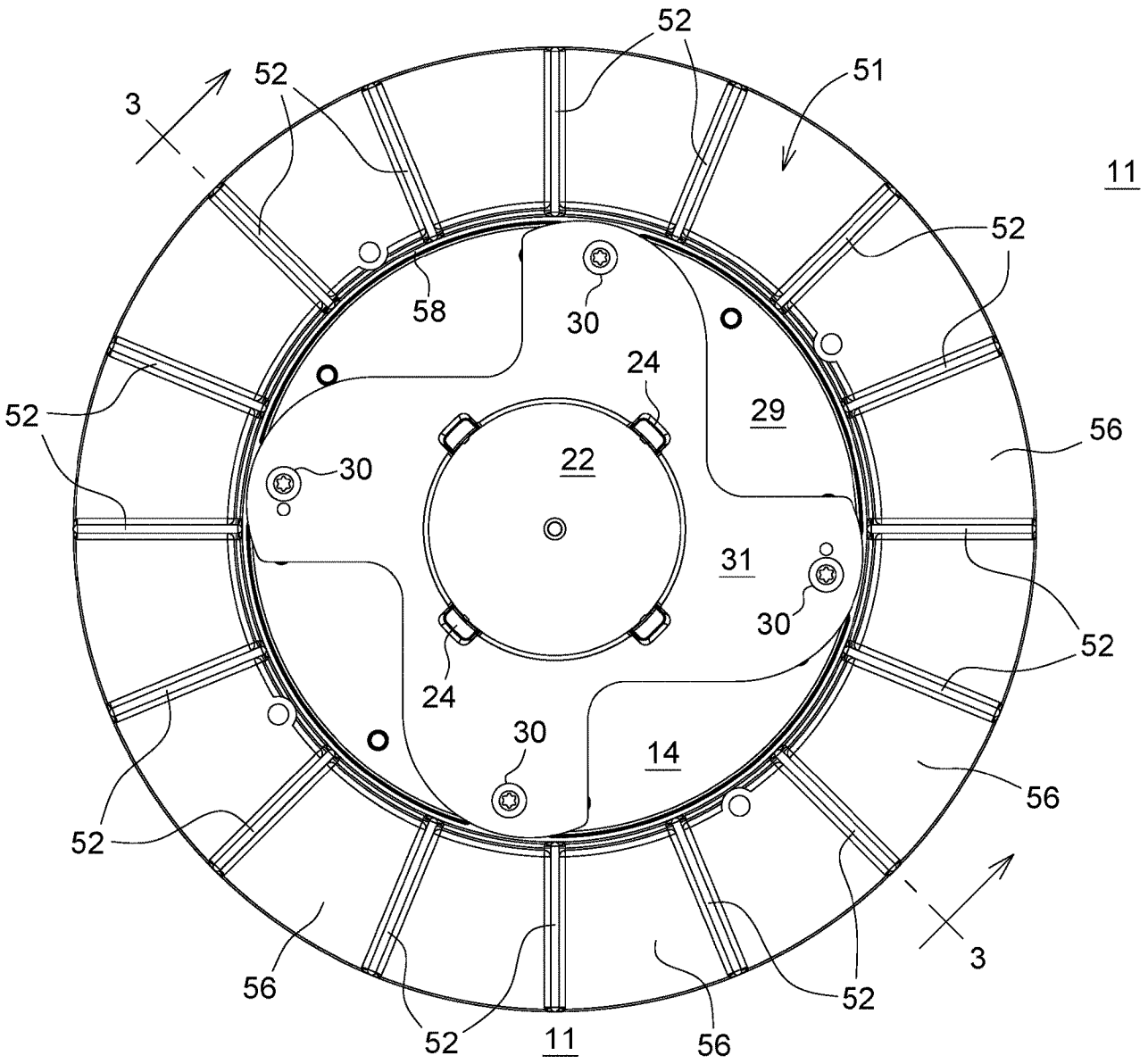
FIG. 2 is a top view of the antenna system of FIG. 1.

In accordance with one embodiment illustrated in FIG. 1, a supplemental device for an antenna system 11 comprises a ring 51 that provides a generally horizontal annular ground plane, where the ring 51 has an interior circumference 53 and a central opening 49. A substantially annular wall 58 or inner annular wall rises or extends vertically from the ring 51 at or near the interior circumference 53. A set of radial members 52 extends radially and vertically upward from the ring 51, where the radial members 52 are spaced apart from each other. One or more antenna elements (26, 28, 126, 128) are positioned in the central opening 49. The supplemental device is well-suited for reducing multipath in the received signals by configuring 51 one or more antenna elements (26, 28, 126, 128) to receive only signals directly from the satellites, not reflected signal, which result from reflections off objects in the surrounding environment. In one configuration, the annular wall 58 or inner annual wall is composed of a metal, an alloy, a metallic coating, or an electrically conductive outer surface.

In one embodiment, the radial members 52 are spaced apart from each other by a known angular separation, or by an inner separation distance 64 at a respective inner radius from the central axis 21 and by an outer separation distance 63 at a respective outer radius from the central axis 21. The outer separation distance 63 is typically greater than the inner separation distance 64. The annular wall 58 has a vertical wall height 60 (or inner wall height) that is lower than a member height 61 of a radial member 52.

The ring 51 has a central opening for receiving an antenna assembly, which includes one or more antenna elements (26, 28, 126, 128). In one configuration, the antenna assembly includes one or more passive reflectors (18, 20, 22) mounted on a dielectric spacer 24 above the antenna elements (26, 28, 126, 128).

A base 77 is separated from the ring 51. A set of pedestals, supports or columns 75 is arranged for supporting the ring 51 above the base. Respective fasteners may engage holes in the ring 51 to secure or attach the columns 75 to the ring 51. The set of pedestals, supports or columns 75 extend downward from the ring 51 to the base 77, where the base may terminate in threaded studs or rods to engage corresponding threaded recesses in the base 77. A plurality of pedestals, supports or columns 76 supports the antenna assembly. For example, the pedestals, supports and columns 76 may be connected between the base 77 and the antenna assembly. In one configuration, the base 77 comprises a dielectric base.

A substantially annular wall 58 extends vertically from the annular wall 58. A substantially annular wall 58 or inner annular wall can attenuate or block reflections (e.g., multipath signals) with low angles of arrival with respect to the horizontal plane. Because the antenna elements (26, 126, 28, 128) receives attenuated reflections and may not even receive blocked reflections, the multipath signals can be reduced in magnitude with respect to unblocked or unattenuated direct path signals from the satellites. Meanwhile, the set of radial members 52 attenuates the flow of electromagnetic energy along an upper outer surface or upper surface 56 of the ring 51.

In one embodiment, the substantially annular wall 58 has a wall height 60 that is coextensive or equal to or greater than a peak height or highest vertical position of one or more antenna elements (26, 126, 28, 128) or the generally planar member 31 of the antenna assembly arranged in a horizontal plane. In another embodiment, the annular wall 58 has a wall height 60 that is equal to or greater than a peak height of one or more antenna elements (26, 126, 28, 128) or the generally planar member 31 of the antenna assembly, but lesser than a height of one or more passive reflectors (18, 20, 22) (e.g., highest passive reflector 22) that is spaced apart and above the radiating elements by a dielectric spacer 24.

Figure 3:
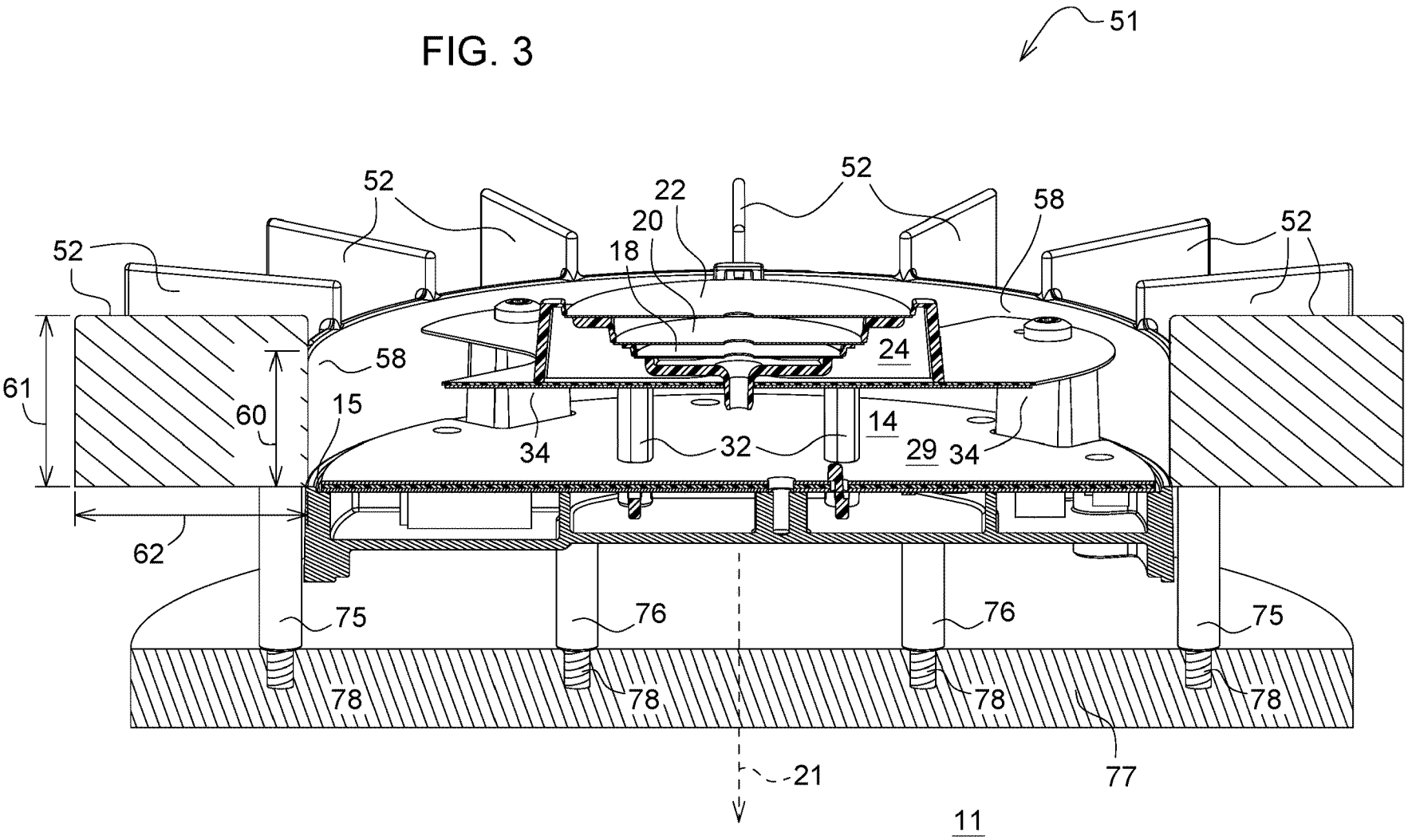
FIG. 3 is a cross section view of the antenna system of FIG. 1 along reference line 3-3.
Figure 4:
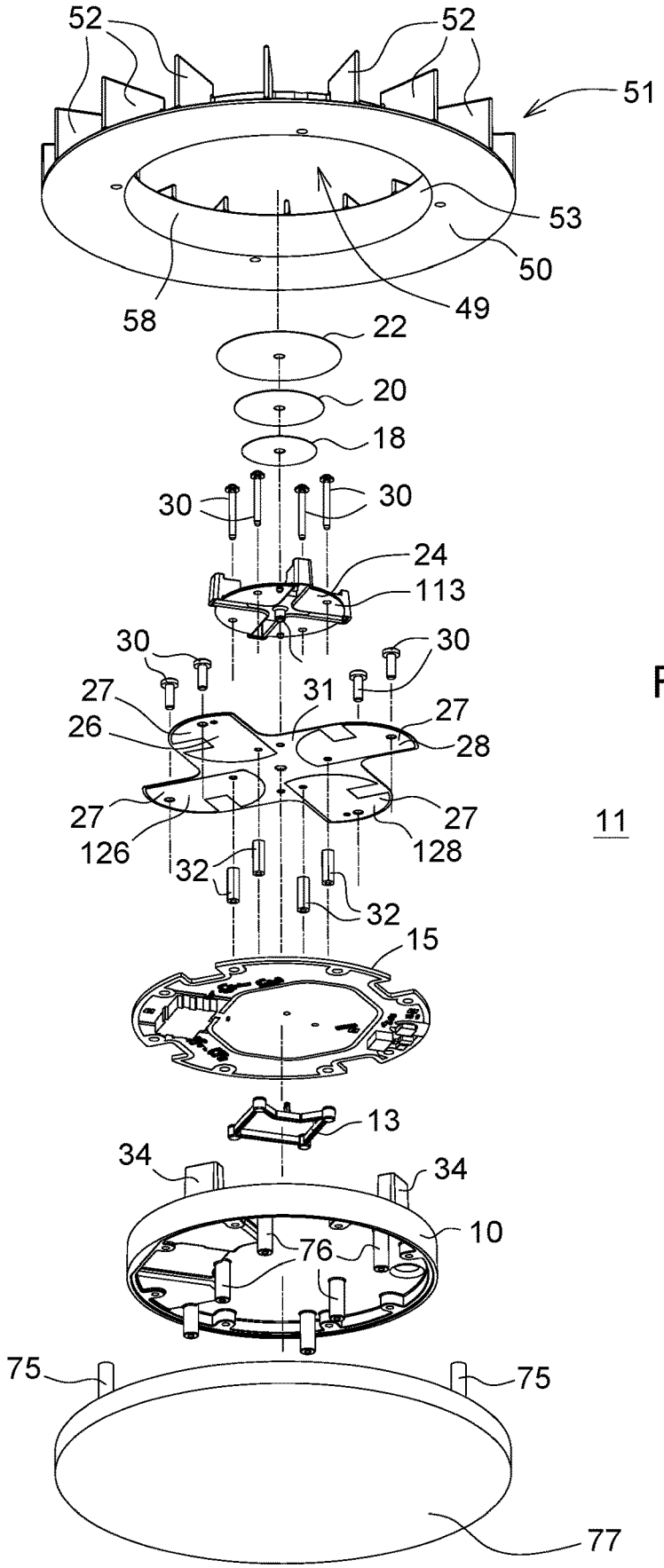
FIG. 4 is an exploded view of the antenna system of FIG. 1.

In accordance with one embodiment, FIG. 1 through FIG. 4, inclusive, illustrate an antenna system 11. For example, the antenna system 11 comprises a group of spatially offset and differently oriented antenna elements (26, 28, 126, 128), such as notched semi-elliptical antenna elements. Each of the antenna elements (26, 28, 126, 128) has a first substantially planar surface 27 (e.g., as illustrated in FIG. 4). An electrically conductive ground plane 14 (e.g., of circuit board 15) has a second substantially planar surface 29 that is generally parallel to the first substantially planar surfaces 27 of the antenna elements (26, 28, 126, 128) by a generally uniform vertical spacing. The ground plane 14 has a central axis 21. Feeding members 32 are adapted for conveying an electromagnetic signal to or from each antenna element (26, 28, 126, 128), or to and from each antenna element. Each of the feeding members 32 is spaced radially outward from the central axis 21 of the ground plane 14. Each feeding member 32 is coupled to or electrically coupled to a respective antenna element, among the antenna elements (26, 28, 126, 128). A grounded member 34 is coupled to or electrically coupled to each antenna element (26, 28, 126, and 128) and spaced apart, radially outward from the feeding member 32.

In one embodiment, one or more passive reflectors (18, 20, and 22) are spaced apart axially from the ground plane 14 and the antenna elements (26, 28, 126 and 128). The passive reflectors (18, 20, 22) may comprise parasitic reflectors. In certain embodiments, the passive reflectors (18, 20, 22) may be referred to as the first reflector 18, second reflector 20 and third reflector 22. Although three passive reflectors (18, 20, 22) are illustrated in FIG. 3 and FIG. 4, in other embodiments one passive reflector may be used. In an alternate embodiment, the passive reflectors (18, 20, 22) may be omitted.

An antenna element (26, 28, 126, and 128) refers to a radiating element, a radiator, or an electrically conductive radiating element, that receives or transmits an electromagnetic signal, such as an electromagnetic signal transmitted from a satellite navigation system, a satellite transmitter, or a satellite transceiver. The antenna element (26, 28, 126, 128) may comprise a modified disk-loaded monopole, for example. In one embodiment, the antenna elements (26, 28, 126, 128) are arranged to provide phase-offset signal components of a received electromagnetic signal by relative orientation of each antenna element with respect to an adjacent antenna element in a clockwise or counter-clockwise direction about a central axis 21 of the antenna system 11 or the ground plane 14, where the clockwise or counter-clockwise direction is observed from a viewpoint above the antenna system 11 In one embodiment, the clockwise orientation of the curved edges of the antenna elements predispose the antenna system 11 to favor stronger reception of right-hand circularly polarized signals, for example.

In one embodiment, the antenna elements (26, 28, 126, 128) may be embedded in, encapsulated in, molded in, or affixed to a generally planar member 31. The generally planar member 31 comprises a dielectric layer or a substantially planar printed wiring board that is composed of a dielectric material. As illustrated, the planar member 31 may be generally shaped a like a disc with dielectric material removed or absent from the periphery where it is not essential to support the antenna elements. In alternate embodiment, the planar member may be substantially disc-shaped.

In one embodiment, each antenna element (26, 28, 126, 128) or individual radiating element may be embodied or modeled as a disk-loaded monopole (DLM) or a modified disk-loaded monopole because it lends itself to be tailored to be approximately resonant over the frequency bands of interest. For microwave frequencies or for reception of satellite navigation signals (e.g., Global Positioning Satellite (GPS) signals), the generally uniform spacing between the ground plane 14 and the antenna elements (26, 28, 126, 128) is approximately 14 millimeters (mm) and the diameter of the ground plane 14 is approximately 120 millimeters (mm), although other configurations fall within the scope of the disclosure and claims.

In one configuration, the antenna system 11 comprises one or more passive reflectors (18, 20, 22) are generally elliptical or generally circular. In another configuration, there is a set of reflectors (18, 20, 22) that have different radiuses. In still another configuration, the set of reflectors comprises a first reflector 18, a second reflector 20 and a third reflector 22 spaced axially apart from each other, where the first reflector 18 has a smaller radius than the second reflector 20 and where the second reflector 20 has a smaller radius than the third reflector 22.

In an alternate embodiment, the passive reflectors (18, 20, 22) are omitted or eliminated from the antenna system 11 or the antenna system. However, such omission or elimination of one or more passive reflectors can cause a degradation in the Axial Ratio (AR) of the antenna.

The passive reflectors (18, 20, 22) are composed of metallic material, metal, an alloy or other electrically conductive material positioned about a central axis 21 or above a central region of the antenna system 11 about the central axis 21. The passive reflectors (18, 20, 22) are located above a portion of the antenna elements (26, 28, 126, 128). One purpose of the passive reflectors (18, 20, 22) is to provide a controlled coupling between the antenna elements (26, 28, 126, 128) or radiating elements such that the axial ratio (AR) is improved. The vertical spacing and diameter of the passive reflectors (18, 20, 22) affects the how much the AR can be reduced, but in general when the disks are positioned lower, the impedance deviates farther from the target impedance (e.g., desired 50 ohms).

In one embodiment, a dielectric supporting structure 24 supports one or more passive reflectors (18, 20, 22) above a central portion about the central axis 21 of the antenna system 11 or spaced apart from the antenna elements. The passive reflector or reflectors (18, 20, 22) may be supported by a dielectric supporting structure 24 or body that is associated with the perimeter or periphery of each passive reflector (18, 20, 22). For example, as illustrated in FIG. 3 the dielectric supporting structure 24 may have slots or recesses that engage the perimeter portion or periphery portion of each passive reflector.

The ground plane 14 may comprise any generally planar surface 29 that is electrically conductive. For example, the ground plane 14 may comprise a generally continuous metallic surface of a substrate or circuit board 15. In one embodiment, the electrically conductive material comprises a metallic material, a metal, or an alloy. In one embodiment, the ground plane 14 is generally elliptical or circular with a generally uniform thickness. In other embodiments, the ground plane 14 may have a perimeter that is generally rectangular, polygonal or shaped in other ways.

In an alternate embodiment, the ground plane 14 may be constructed from a metal screen or metallic screen, such as metal screen that is embedded in, molded or encapsulated in a polymer, a plastic, a polymer matrix, a plastic matrix, a composite material, or the like.

In one embodiment, the grounded member 34 has a generally rectangular cross section, although other polygonal or other geometric shapes may work and can fall within the scope of the claims. Each grounded member 34 may comprise a spacer. Each grounded member 34 is mechanically and electrically connected to the ground plane 14 and a corresponding antenna element (26, 28, 126, 128). For example, a first end (e.g., lower end) of each grounded member 34 is connected to the ground plane 14, whereas a second end of each grounded member 34 is connected to the corresponding antenna element (26, 28, 126, 128). In one embodiment, the grounded members 34 are positioned radially outward from the feeding members 32 with respect to the central axis 21.

The feeding member 32 is electrically insulated or isolated from the ground plane 14. In one example, an air gap or a clearance is established between the feeding members 32 and an opening the ground plane 14 of the circuit board 15. In another example, an insulator or insulating ring may be placed between the feeding member 32 and an opening in the ground plane 14. As illustrated in FIG. 3, a first end (e.g., upper end) of each feeding member 32 is mechanically and electrically connected to a corresponding antenna element (26, 28, 126, 128). For example, the antenna element (26, 28, 126, 128) may have a recess for receiving the feeding member 32, where the recess has a cross-sectional shape (e.g., substantially hexagonal shape) corresponding substantially to the size and shape of the feeding member 32, or a protrusion located thereon. In one embodiment, the feeding member 32 has a generally polygonal cross section. Accordingly, the recess (e.g., substantially polygonal recess) in a corresponding antenna element may engage or mate with the generally polygonal cross section. In another embodiment, the feeding member has a generally circular cross section. In one configuration, the recess is soldered to the generally polygonal cross section or bonded with conductive adhesive. The feeding member 32 is composed of metal, a metallic material, an alloy or another electrically conductive material.

A first end of each feeding member 32 is electrically connected to an antenna element, while a second end, opposite the first end, is electrically connected to one or more conductive traces of a circuit board 15, for instance. The conductive traces may be associated with an impedance matching network.

In FIG. 1 through 4, inclusive, the antenna system 11 uses four antenna elements (26, 28, 126, 128) or radiating elements individually driven by four received signals, where each received signal differs in phase by 90 degrees from the adjacent signal or signals. For example, in the antenna system 11 in a reception mode, the signal inputted from each antenna element (26, 28, 126, 128) or antenna element is 90 degrees out of phase with respect to adjacent signals. Similarly, in a transmission mode or a dual transmission and reception mode, a transmitted signal can be inputted to each antenna element is 90 degrees out of phase with respect to the adjacent signals.

FIG. 4 shows an exploded view of the antenna system 11. The antenna may include an optional frame 13 that aligns with a central bore 113 in the supporting structure 24 or its base to facilitate alignment of the fasteners 30 with fasteners (e.g., threaded inserts) embedded in the optional frame 13, or threaded bores in the optional frame 13.

In location-determining receiver or Global Navigation Satellite System (GNSS) receiver, such as a Global Positioning System (GPS) receiver, a Global Navigation Satellite System (GLONASS) receiver, or a Galileo receiver, that use carrier phase measurements and correction signals (e.g., differential correction signals) from one or more reference receivers, multipath tends to be a source of position error. The reception of multipath signals can degrade both timing and position accuracy in GNSS receivers.

The supplemental device supports the reception of direct signals and rejects or attenuates the reflected signals to reduce multipath signals received at the GNSS receiver. Although it is not always possible to completely reject multipath signals by antenna system configured with the supplemental device, the supplemental device uses the elevation angle of arrival and the polarization of the reflected signals to reduce multipath. First, the elevation angle of arrival for reflected signals is usually below the horizon because the GNSS receiver is elevated above the ground and the ground can be an efficient reflector. Accordingly, the geometric configuration of the annular wall 58 and ring 51 can attenuate or block signals with low elevation of arrival from reaching the antenna elements or the antenna assembly. Second, the reflected signals often have Left Hand Circular Polarization (LHCP), rather than the Right Hand Circular Polarization (RHCP) of the direct signal, where LHCP can be favored for reception.

One approach to preventing reflected signals (from the ground) with low angles of arrival from reaching the antenna is to place the antenna elements (26, 28, 126, 128) on an upper side of a horizontal conductive surface known as a ground plane, such as a ground plane 14, which represents a primary conductive ground plane, and the ring 51, which represents a secondary conductive ground plane. In one configuration, the ground plane can be generally circular in shape, whereas in other embodiments, the ground plane may comprise a combination of the primary ground plane (e.g., ground plane 14) and the secondary ground plane (e.g., ring 51). Because GNSS signals in the microwave frequency range only penetrate a conductor to a few microns, a bottom side of the conductive ground plane will block reflected signals from the ground from reaching the antenna elements, while providing no impediment to direct signals from satellites in the sky (e.g., with azimuth angles that support higher angles of arrival of direct signals at the antenna system). One problem with using a conductive ground plane to reduce multipath is that the direct signals will impinge on the ground plane's upper surface (e.g., upper surface 56 of ring 51) and induce microwave or other radio frequency (RF) currents in the ground plane (e.g., ring 51). The induced RF currents will in turn radiate, and possibly be received by one or more antenna elements (26, 28, 126, 128) of the antenna. The flow of the RF currents tends to occur in all directions on the ground plane. Because the ground plane is finite, the RF currents will set up standing-wave patterns that depend on the receive frequency and the ground plane dimensions. The standing-wave patterns result in re-radiation of phase-delayed versions of the received signal, which is effectively another source of multipath signals.

To reduce reception of signals with a low elevation angle of arrival, the supplemental device may use a modified choke ring, such as ring 51. In certain background art, a conventional choke ring 51 can be constructed of a series of concentric cylinders with the antenna elements in a center opening of the concentric cylinders. By making the depth of the resultant channels between the cylinders equal to one quarter of a wavelength the top edge of the cylinders will have a high impedance to RF signals of that wavelength. For GPS L2 signals the channel depth will be 61 mm, while the typical choke ring 51 diameter is 370 mm. For many applications, a conventional choke ring 51 is simply too large and heavy to be practical. Accordingly, the modified choke ring 51 of the supplemental device and antenna system uses a single annular wall 58 that extends upward from the ring ground plane or upper surface 56 to reduce the reception of multipath or reflected signals at the receive antenna elements (26, 126, 28, 128) in the central opening 49. In one configuration, the annular wall 58 can be set to wall height 60 of one quarter of a wavelength for the L1 signal, the L2 signal, or an intermediate frequency that is the average or mean of the wavelengths of the L1 signal and L2 signal.

In one embodiment, the ring 51 forms a substantially annular ground plane that blocks or attenuates, or both blocks and attenuates, electromagnetic radiation or reflected satellite signals (e.g., multipath) from below the horizon, while allowing direct path satellite signals to arrive at the antenna elements (26, 126, 28, 128) without any material attenuation from the ring 51. Further, the ring 51 has structural features, such as radial members 52, which reduce the flow of radio frequency (RF) current or microwave current on its horizontal surface or upper surface 56. If the ring 51 is oriented in a generally horizontal plane, the horizontal conducting surface or upper surface 56 cannot support a horizontal electrical field (E-field) of the received signal (e.g., in a microwave or satellite frequency band) but a current flow on such upper surface 56 will be accompanied by an electrical field which is normal to the surface of the right. If that normal E-field is suppressed, then the current flow on the surface will be correspondingly suppressed. A conducting surface (e.g., radial member 52), which is generally perpendicular to the ring 51 or horizontal surface (e.g., upper surface 51) of the ring 51, will not support the propagation of a vertical E-field. In one configuration, the supplement device comprises a series or ensemble of radial members 52, with such perpendicular (i.e. vertically oriented) surfaces on the upper surface 56 of the ring 51 in a generally horizontal plane, such that the radial members 52 reduce the vertical E-fields, and hence reduce the RF current flow and microwave current flow of potentially induced multipath signals.

In one embodiment, the supplemental device requires a combination of vertical and horizontal conducting surfaces to both prevent signals from below the horizon from reaching the antenna and to minimize the propagation of induced RF currents, on the upper surface 56 of the ring 51, that would otherwise contribute to multipath. The radial members 52 or radial plates extend upward and perpendicularly from an upper surface 56 of the ring 51.

The radial members 52 or radial plates are arranged in a radial fashion on the horizontal surface, where the radial members 52 are separated from each other by an angle. The angle or spacing between the plates determines how the RF signals interact with the supplemental device. If the radial members 52 or radial plates are spaced too far apart from each other there will be regions of the horizontal ground plane that do not inhibit the vertical E-fields; hence, contribute to induced RF currents on the surface of the ring 51 that contribute to multipath reception by the antenna. However, if the radial members 52 or radial plates are too close together with respect to the wavelength of the received signal, the received signal or direct signal (without multipath components) will not be able to penetrate the spatial volume between the plates. Therefore, the received signal or direct signal will only interact with the top edges of the radial members 52 or radial plates, which results in minimal suppression of the horizontal currents on the upper surface 56 of the ring 51 or ground plane. Through electromagnetic simulation, it has been found that 40 millimeters (mm) spacing is about the maximum spacing between radial members 52 for GPS L2 signals (1227 MHz). Conversely, a minimal spacing of less than 30 mm starts to prevent the L2 signal from interacting with the structure. For example, in the supplement device with a diameter of 150 mm for the antenna system of FIG. 1, a quantity of sixteen plates results in an inner spacing 64 of 30 mm along the respective inner circumference 53 of the ring and an outer separation distance 63 (or outer spacing) of 40 mm along the respective outer circumference of the ring. For a smaller antenna element fewer radial members 52 or plates would be desirable, and for a larger antenna it would take more plates to provide the correct spacing.

When a radial member 52 or radial plate is wider and taller it has more vertical surface area to interact with the RF signal; hence, reduce the vertical E-fields. The other effect of larger radial plates is that the RF currents flowing on the radial plate will form standing waves which can distort the gain pattern. Through electromagnetic simulation is was found that a member width 62 of approximately 40 mm and a member height 61 of approximately 32 mm (of corresponding radial members 52) provides a strong interaction with GPS frequency signals while keeping the gain as a monotonic function of received elevation angle. As used herein, approximately shall mean a tolerance of plus or minus ten percent.

In alternate embodiments, the radial members 52 can be replaced or supplemented by a forming a resistive ground plane an upper surface (e.g., upper surface 56) of the ring (e.g., ring 51). For example, by manufacturing the ring as a ground plane with an electrical sheet resistivity that increases from the inner circumference to the outer circumference 54 of the ring, the current flow on the surface is reduced to near zero at the outer circumference 54 at the wavelength or frequency of the received signal. The gradient in the electrical sheet resistivity of the upper surface (e.g., upper surface 56) of the ring prevents signals incident on the lower surface (e.g., lower surface 50) of the ring from propagating to the upper surface where they could be received by one or more antenna elements. Manufacture of the ground plane with tapered resistive profile can be accomplished by printing the ring with a three-dimensional printer that varies inversely varies the amount of conductive metal particles embedded in a polymeric matrix, plastic matrix or binder to achieve the desired target gradient in the resistivity of the ring.

In another alternate embodiment, the ring (e.g., ring 51) comprises a band-gap, surface ground plane with a repeating a reactive element over a surface to create a structure with a high impedance to RF current at particular frequencies or wavelengths of the received satellite signal. The reactive elements have been realized with printed fractal patterns, metamaterials, and with lumped element inductors and capacitors. Although this approach has been demonstrated for individual or particular GNSS bands, to cover all of the GNSS frequencies now in use would require a fractional bandwidth of approximately twenty-five percent, which requires a more complex design with multiple resonant points.

In one embodiment, as indicated above, the supplemental device uses polarization selectivity to reduce multipath in the received signal. Because the reflected signals tend to be LHCP and the direct signals are generally exclusively RHCP by convention for the applicable bands of the satellite signals, a supplemental device which maximizes the RHCP reception of the antenna system, while minimizing the LHCP reception will reject at least some multipath.

The Axial Ratio (AR) is a measure of how pure the circular polarization of an antenna is. An RHCP antenna with an AR of 1 (0 dB) has perfect rejection of LHCP. Most GNSS antennas have very low AR at high elevation angles, such as toward the zenith, but the AR tends to degrade for elevations closer to the horizon.

Figure 5:
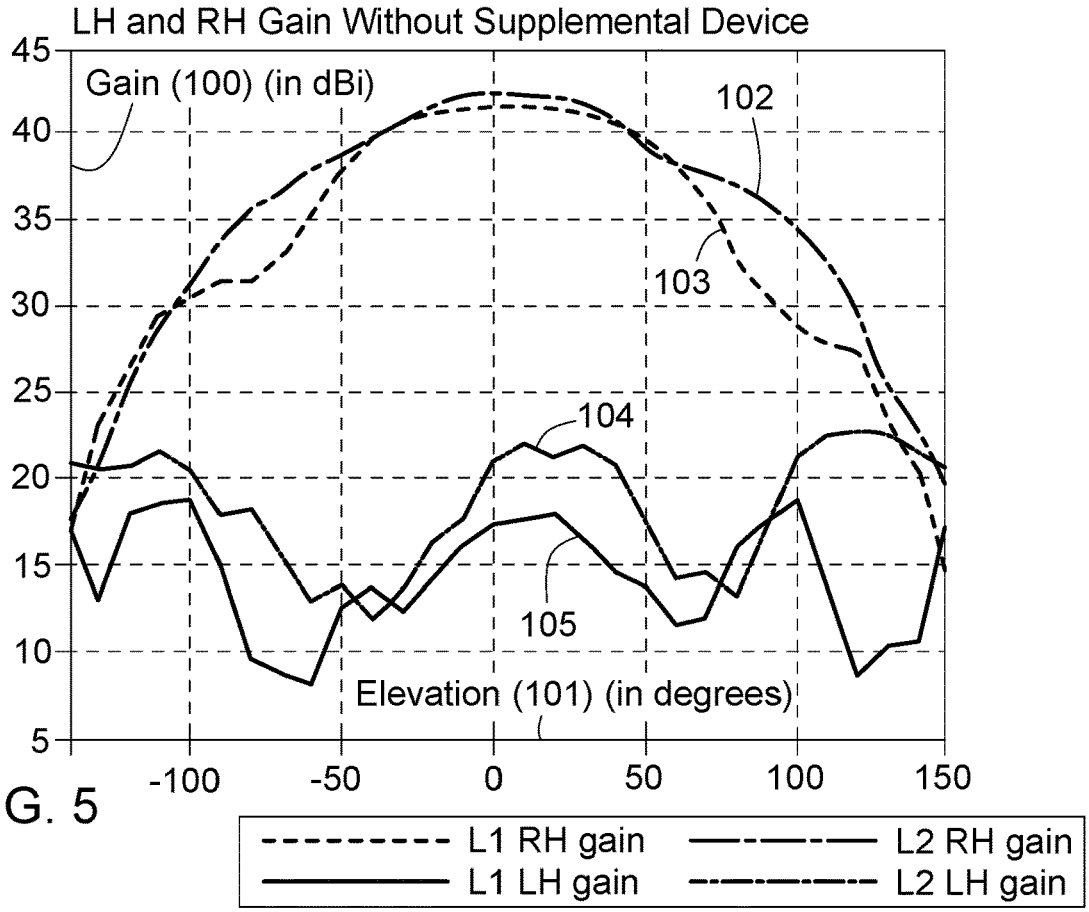
FIG. 5 is a chart of gain versus elevation for the antenna system with the supplemental device removed.

FIG. 5 illustrates the performance of the antenna system without the supplemental device (e.g., ring 51). In other words, FIG. 5 shows the gain pattern of a conventional GNSS antenna as a function of elevation angle, with 0 degrees being zenith. In FIG. 5, the vertical axis 100 represents gain in Decibels relative to an isotropic antenna element (dBi), whereas the horizontal axis 101 represents elevation in degrees. The gain versus elevation is plotted for received signals at the L1 frequency and received signals at the L2 frequency, where right-hand (RH) gain and left-hand (LH) gain is measured for received signals that are typically transmitted as right-hand circularly polarized (RHCP) signals. The L1 RH gain is represented by a dashed line 103; the L1 LH gain is represented by a solid line 105; the L2 RH gain is represented by an alternating short-and-long dashed line 102; the L2 LH gain is represented by an alternating dot-and-long dashed line 104.

Figure 6:
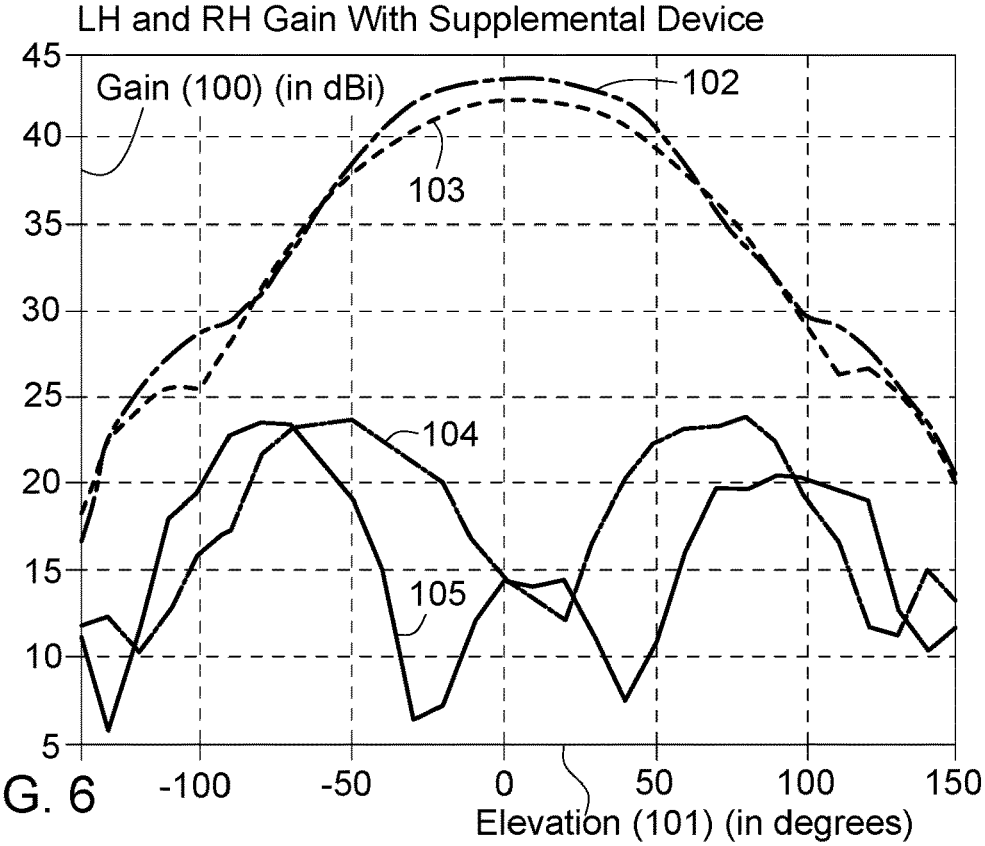
FIG. 6 is a chart of gain versus evaluation for the antenna system with the supplemental device installed.

FIG. 6 shows the gain pattern for the same antenna system with the supplemental device (e.g., ring 51). In FIG. 5, the vertical axis 100 represents gain in Decibels relative to an isotropic antenna element (dBi), whereas the horizontal axis 101 represents elevation in degrees. One can see that the gain at zenith is affected very little by the supplemental device. At 10 degrees below the horizon (−100 degrees in the plots) the right-hand (RH) gain for the Global Positioning System (GPS) L1 frequency drops from 30 Decibels isotropic gain (dBi) to 26 dBi with the supplemental device, and the RH gain for the GPS L2 frequency drops from 30 dBi to 28 dBi with the supplemental device. Further, the left-hand (LH) gain does not increase for either the L1 or L2 frequency for elevations below the horizon. The L1 RH gain is represented by a dashed line 103; the L1 LH gain is represented by a solid line 105; the L2 RH gain is represented by an alternating short-and-long dashed line 102; the L2 LH gain is represented by an alternating dot-and-long dashed line 104.

Figure 7:
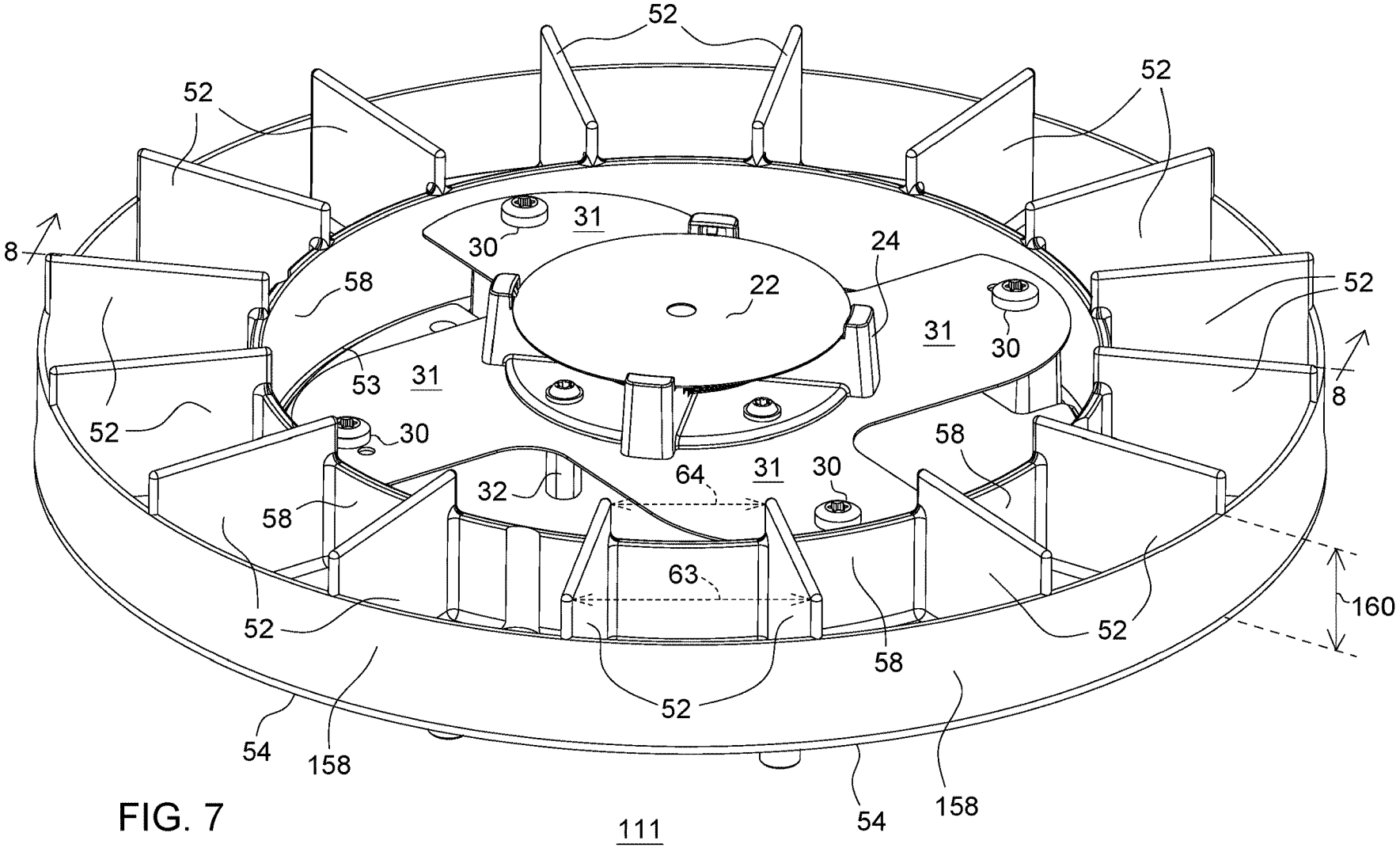
FIG. 7 is a perspective top via of an alternate embodiment with an inner annular wall and an outer annular wall.

FIG. 7 is a perspective top view of an alternate embodiment of an antenna system 111 with an inner annular wall 58 and an outer annular wall 158, where both annular walls (58, 158) are composed of a metal, an alloy, a metallic coating, or an electrically conductive outer surface. In one embodiment, a substantially annular outer wall 158 vertically rises from the ring 51 at or near its outer circumference 54.

The inner annular wall 58 and the outer annual wall 158 may be configured in accordance with various configurations, which may be applied alternately or cumulatively. Under a first configuration, a height of one or both annular walls (58, 158) is within a range equal to or less than the member height 61 of the radial members 52 of the ring 51 (e.g., choke ring). For example, an outer wall height 160 of an outer annular wall 158 is within a range equal to or less than the radial members of the ring 51; an inner height of an inner annular wall is within a range equal to or less than the radial members of the ring 51.

Under a second configuration, the outer annular wall has an outer wall height 160 less than the inner wall height 60 of the inner annular wall 58.

Under a third configuration, the inner wall height 60 of the inner annular wall 58 is selected to facilitate suppression and/or attenuation of the received multipath signals at a range of low propagation angles with respect to the ground plane (e.g., generally horizontal plane) of the ring 51 (or ground plane 14 of the centrally positioned antenna elements (26, 28, 126, 128)) within the central opening 49 (e.g., in FIG. 4) of the ring 51, where the direct signals associated with the delayed multipath signals have higher propagation angles with respect to the ground plane (e.g., generally horizontal plane).

Under a fourth configuration, the outer wall height 160 of the outer annular wall 158 is selected to facilitate suppression and/or attenuation of the received multipath signals at a range of low propagation angles with respect to the ground plane (e.g., generally horizontal plane) of the ring 51 (or ground plane 14 of the centrally positioned antenna elements (26, 28, 126, 128)) within the central opening 49 of the ring 51, where the direct signals associated with the delayed multipath signals have higher propagation angles with respect to the ground plane (e.g., generally horizontal plane).

Figure 8:
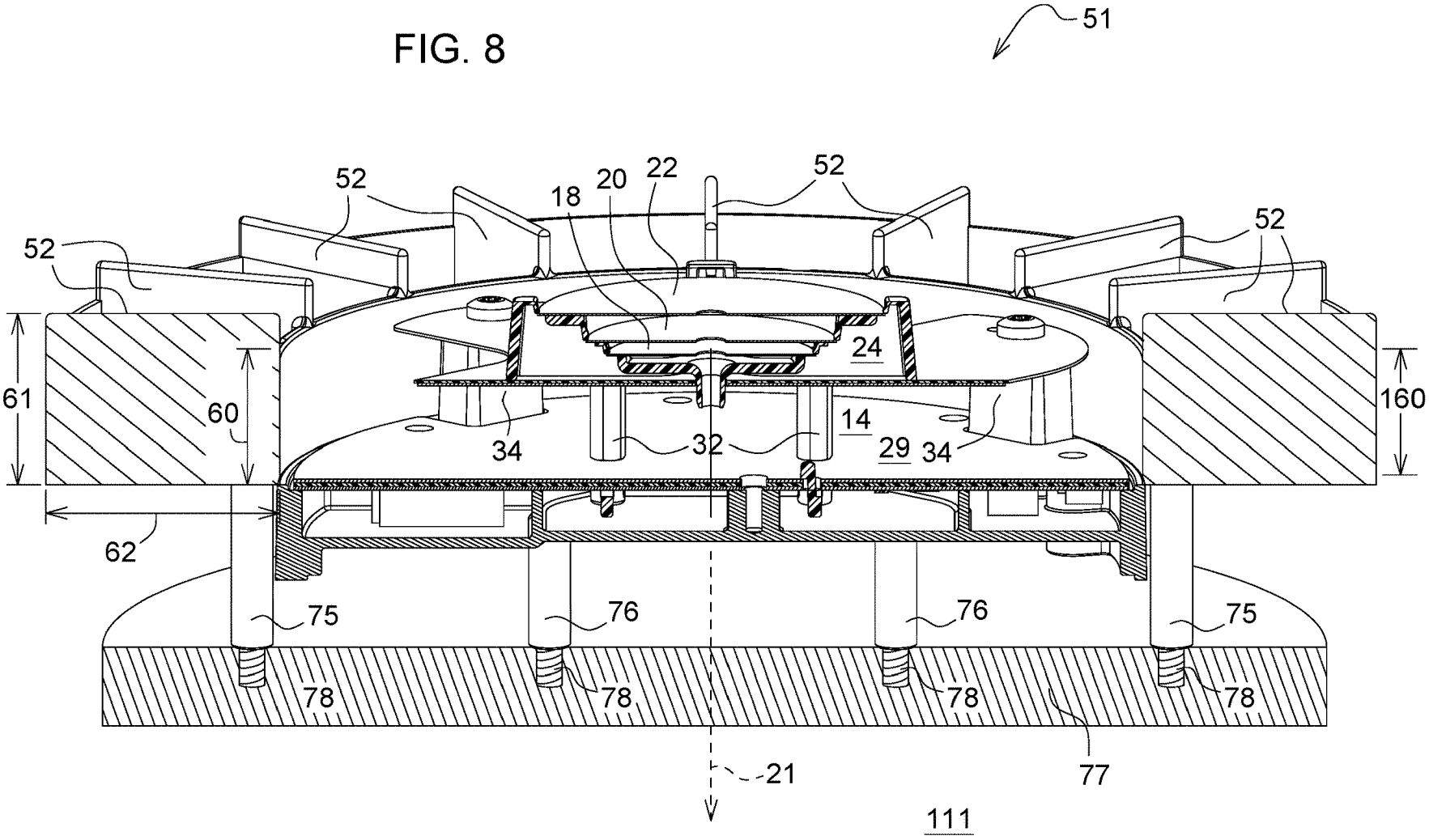
FIG. 8 is a cross section view of the antenna system of FIG. 7 along reference line 8-8.

FIG. 8 is a cross sectional view of the antenna system 111 of FIG. 7 along reference line 8-8. As illustrated in FIG. 8, the inner annular wall 58 and the outer annular wall 158 are generally concentric about a central axis 21. Any annular wall configuration of FIG. 7 and FIG. 8 may be selected based on the environment surrounding the antenna system 111 and height of the antenna above the ground, such as height above average terrain around the antenna. In one example, if the antenna system 111 is mounted on a vehicle (e.g., off-road vehicle), the height above average terrain can vary as the vehicle traverses through a work area or field, which can impact multipath-reduction performance of the antenna. In another example, multipath-reduction performance may depend on the relative alignment, distance, distribution, size, reflectivity, and frequency response, of various buildings, terrain, trees, vegetation, water, obstructions or other items with respect to the antenna system. The environment can impact the characteristics of direct path and multipath signals received at the antenna system.

Figure 9:
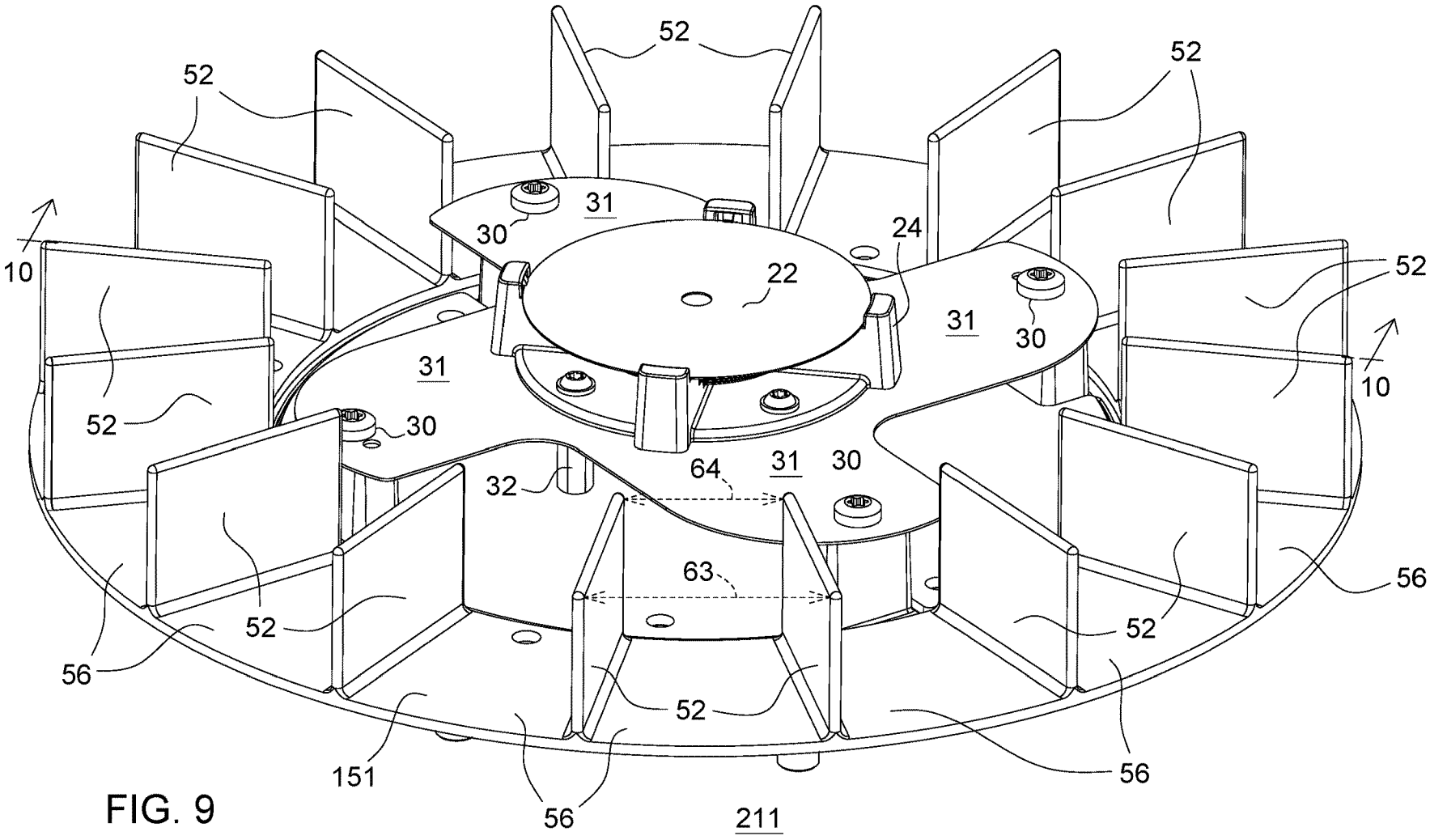
FIG. 9 is a perspective top via of another alternate embodiment with no annular walls.

FIG. 9 is a perspective top view of another alternate embodiment of an antenna system 211 with no annular walls. For example, the ring 151 of FIG. 9 is not associated with an inner annular wall 58 or an outer annular wall 158 (of FIG. 7 and FIG. 8) such that only the ring 151 and the radial members 52 of the ring 151 facilitate suppression and/or attenuation of the received multipath signals with respect to the direct path (satellite) signal received at the centrally positioned antenna elements (26, 28, 126, 128) with respect to the central axis 21, or its intercept point, within the opening 49 of the ring 151.

In one embodiment, the antenna system 211 comprises a ring 151 that provides a generally horizontal ground plane, where the ring 51 has an interior circumference with a central opening 49. A set of radial members 52 extend radially upward from the ring 151. The radial members 52 spaced apart from each other. Antenna elements (or radiating members) (26, 28, 126, 128) are positioned in the central opening 49.

In one configuration, the radial members 52 are spaced apart from each other by a known angular separation. A pair of members (e.g. a feed member and a grounded member) are associated with each antenna element (26, 28, 126, 128).

In one embodiment, the antenna system 211 may further comprise a base 77 separated from the ring 151, where a set of outer pedestals, supports or columns 75 are arranged to support the ring 151 above the base 77. The set of outer pedestals, supports or columns 75 may extend downward to the base 77. A set of inner pedestals, supports or columns 76 are arranged to support the antenna assembly 68 (within the central opening 49 or oriented with a target alignment to the ring 151, where the columns 76 are connected to the base 77. The antenna assembly 68 comprises the antenna elements (26, 28, 126, 128), reflectors (18, 20, 22), dielectric spacer 24 and a conductive ground plane 14. The set of radial members 52 attenuates the flow of electromagnetic energy along an upper outer surface or the ring 151.

Figure 10:
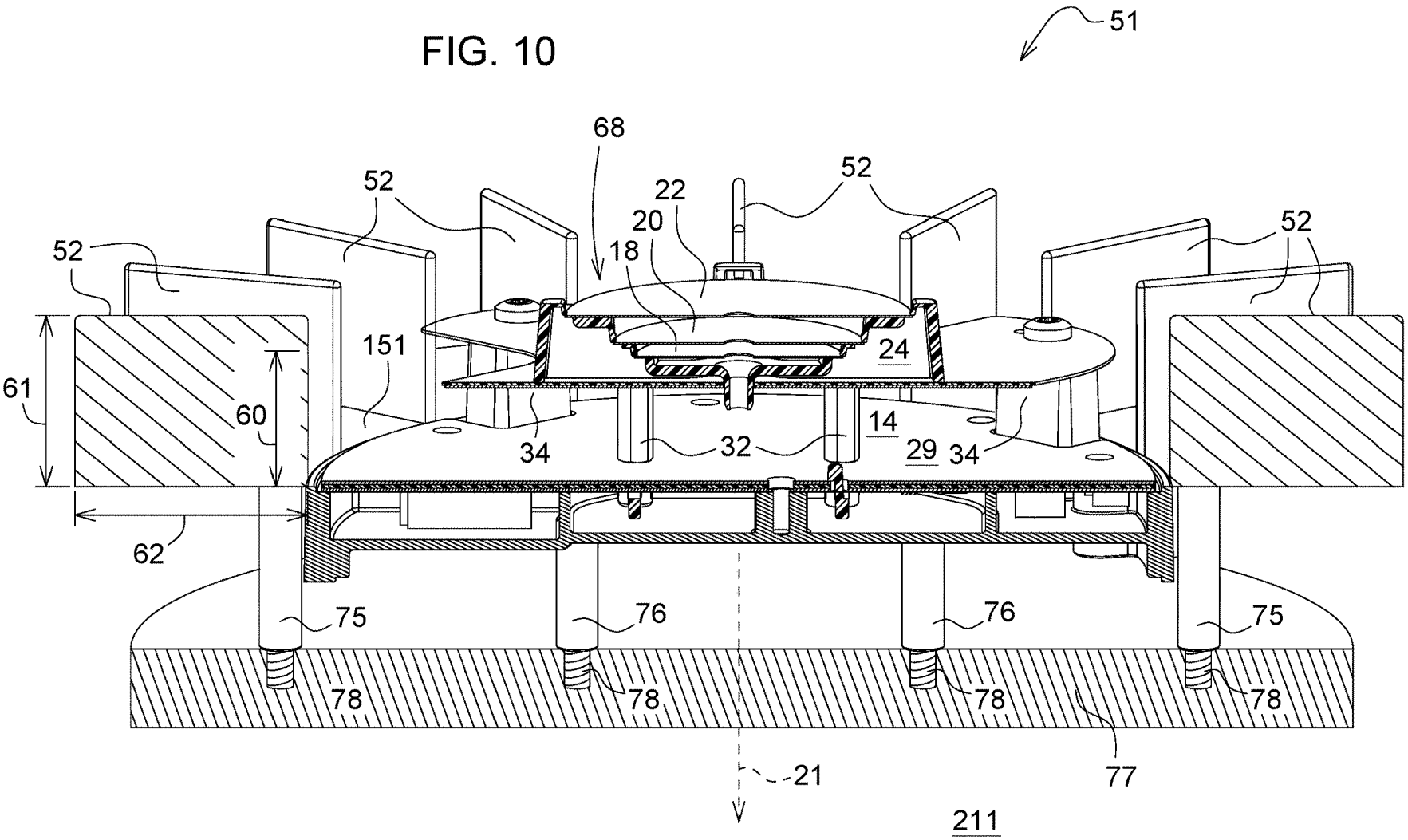
FIG. 10 is a cross section view of the antenna system of FIG. 9 along reference line 10-10.

FIG. 10 is a cross section view of the antenna system 211 of FIG. 9 along reference line 10-10. The configuration of FIG. 9 and FIG. 10 without any annular walls (58, 158) may be selected based on the environment surrounding the antenna system 211 and height of the antenna above the ground, such as height above average terrain around the antenna. In one example, if the antenna system 211 is mounted on a vehicle (e.g., off-road vehicle), the height above average terrain can vary as the vehicle traverses through a work area or field, which can impact multipath-reduction performance of the antenna. In another example, multipath may depend on the relative alignment, distance, distribution, size, reflectivity, and frequency response, of various buildings, terrain, trees, vegetation, water, obstructions or other items with respect to the antenna system. The environment can impact the characteristics of direct and multipath signals received at the antenna system.

The supplemental device is well-suited for reducing the deleterious effects of multipath on the received signal. Moreover, the supplemental device can complement electronic mitigation or reduction of multipath. Because the reflected signal will always arrive later than the direct signal, the receiver can electronically block the signal after the received first edge to prevent subsequent edges from affecting the time measurement of carrier phase edge or code edge. Electronic mitigation can be effective when the path differential between the direct and reflected signals is greater than a few nanoseconds. However, with the path differential is less than a few nanoseconds, the limited bandwidth of the receiver will blur the edges into a single distorted edge from which the first edge cannot be extracted. Accordingly, electronic multipath mitigation is only capable of improving the measurement of code edge arrival time, the carrier phase of the received signal cannot be recovered electronically once it is shifted by multipath. Because carrier phase measurements are used in all high precision GNSS receivers to provide more precise position estimates, the supplemental device is essential to improve antenna multipath mitigation for carrier phase measurements; hence, accuracy of position estimates.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

The following is claimed:

1. A supplemental device for an antenna system, the device comprising:

a ring providing a generally horizontal annular ground plane, the ring having an interior circumference with a central opening;

a substantially annular wall rising from the ring at or near the interior circumference, the annular wall being electrically conductive;

a plurality of antenna elements positioned in the central opening;

a passive reflector that is spaced apart and above the antenna elements by a dielectric spacer; and a set of radial members extending radially upward from the ring, the radial members spaced apart from each other, wherein the annular wall has a wall height that is equal to or greater than a height of one or more of the antenna elements, but lesser than a height of the passive reflector.

2. The device according to claim 1 wherein the radial members are spaced apart from each other by a known angular separation.

3. The device according to claim 1 wherein the annular wall has a vertical wall height that is lower than a member height of a radial member.

4. The device according to claim 1 wherein an antenna assembly is positioned in the central opening and comprises the antenna elements that are fed and the passive reflector.

5. The device according to claim 1 further comprising:

a base separated from the ring;

a set of pedestals for supporting the ring above the base; wherein the ring has the set of pedestal supports extending downward to the base.

6. The device according to claim 5 further comprising:

a plurality of columns for supporting an antenna assembly comprising the antenna elements, the columns being connected to the base.

7. The device according to claim 6 wherein the base comprises a dielectric base.

8. The device according to claim 1 wherein the substantially annular wall attenuates reflections with low angles or arrival with respect to the horizontal plane.

9. The device according to claim 1 wherein the set of radial members attenuates the flow of electromagnetic energy along an upper outer surface of the ring.

10. The device according to claim 1 wherein the antenna elements comprise one or more radiating elements of the antenna assembly arranged in a horizontal plane.

11. The device according to claim 1 further comprising a substantially annular outer wall rising from the ring at or near the outer circumference.

12. The device according to claim 11 wherein the substantially annular outer wall has an outer wall height within a range equal to or less than the height of the radial members on the ring.

13. The device according to claim 11 wherein the substantially annular outer wall has an outer wall height less than the inner height of the substantially annular wall, where the substantially annular wall, which extends vertically from an interior circumference of the ring, comprises a substantially annular inner wall.

14. An antenna system comprising:

a ring providing a generally horizontal annular ground plane, the ring having an interior circumference with a central opening;

a substantially annular wall rising from the ring at or near the interior circumference, the annular wall being electrically conductive;

a plurality of antenna elements positioned in the central opening;

one or more passive reflectors being spaced apart and above the antenna elements by a dielectric supporting structure; and a set of radial members extending radially upward from the ring, the radial members spaced apart from each other, wherein the annular wall has a wall height that is equal to or greater than a height of one or more of the antenna elements, but lesser than a height of the one or more passive reflectors.

15. The antenna system according to claim 14 wherein the radial members are spaced apart from each other by a known angular separation.

16. The antenna system according to claim 14 wherein the annular wall has a vertical wall height that is lower than a member height of a radial member.

17. The antenna system according to claim 14 further comprising a pair of feed members and grounded members associated with each antenna element.

18. The antenna system according to claim 14 further comprising:

a base separated from the ring;

a set of pedestals for supporting the ring above the base; wherein the ring has the set of pedestal supports extending downward to the base.

19. The antenna system according to claim 18 further comprising:

a plurality of columns for supporting an antenna assembly comprising the antenna elements, the columns being connected to the base.

20. The antenna system according to claim 18 wherein the base comprises a dielectric base.

21. The antenna system according to claim 14 wherein the substantially annular wall attenuates reflections with low angles or arrival with respect to the horizontal plane.

22. The antenna system according to claim 14 wherein the set of radial members attenuates the flow of electromagnetic energy along an upper outer surface or the ring.

23. The antenna system according to claim 14 wherein the antenna elements comprise one or more radiating elements of the antenna assembly arranged in a horizontal plane.

24. The antenna system according to claim 14 wherein the one or more passive reflectors comprise parasitic reflectors.

25. The antenna system according to claim 14 further comprising a substantially annular outer wall rising from the ring at or near the outer circumference.

26. The antenna system according to claim 25 wherein the substantially annular outer wall has an outer wall height within a range equal to or less than the height of the radial members on the ring.

27. The antenna system according to claim 25 wherein the substantially annular outer wall has an outer wall height less than the inner height of the substantially annular wall, where the substantially annular wall, which extends vertically from an interior circumference of the ring, comprises a substantially annular inner wall.

28. An antenna system comprising:

a ring providing a generally horizontal annular ground plane, the ring having an interior circumference with a central opening;

a substantially annular wall rising from the ring at or near the interior circumference;

an antenna assembly comprising one or more radiating antenna elements and a passive reflector;

a set of radial members extending radially upward from the ring, the radial members spaced apart from each other, wherein the annular wall has a wall height that is equal to or greater than a height of the one or more radiating antenna elements of the antenna assembly, but lesser than a height of a passive reflector that is spaced apart and above the radiating antenna elements by a dielectric spacer; and a plurality of antenna elements positioned in the central opening.

29. The antenna system according to claim 28 wherein the radial members are spaced apart from each other by a known angular separation.

30. The antenna system according to claim 28 further comprising a pair of feed members and grounded members associated with each antenna element.

31. The antenna system according to claim 28 further comprising:

a base separated from the ring;

a set of pedestals for supporting the ring above the base; wherein the ring has the set of pedestal supports extending downward to the base.

32. The antenna system according to claim 31 further comprising:

a plurality of columns for supporting the antenna assembly, the columns connected to the base.

33. The antenna system according to claim 28 wherein the set of radial members attenuates the flow of electromagnetic energy along an upper outer surface or the ring.

* * * * *